US006759936B2

(12) United States Patent
Yeh et al.

(10) Patent No.: US 6,759,936 B2
(45) Date of Patent: Jul. 6, 2004

(54) TRANSFORMERS USING COIL MODULES AND RELATED MANUFACTURING METHOD THEREOF

(75) Inventors: Ming Yeh, Pan Chiao (TW); Steven Wu, Pa Te (TW); Anthony Du, Taipei (TW)

(73) Assignee: Delta Electronics, Inc., Taoyuan Hsien (TW)

( * ) Notice: Subject to any disclaimer, the term of this patent is extended or adjusted under 35 U.S.C. 154(b) by 0 days.

(21) Appl. No.: 10/304,811

(22) Filed: Nov. 26, 2002

(65) Prior Publication Data

US 2004/0100348 A1 May 27, 2004

(51) Int. Cl.[7] ..... H01F 27/02

(52) U.S. Cl. ..... 336/90; 336/83; 336/96; 336/200; 336/223; 336/232; 29/602.1

(58) Field of Search ..... 336/90, 200, 232, 336/223, 86, 96, 83; 29/602.1

(56) References Cited

U.S. PATENT DOCUMENTS 5,175,525 A * 12/1992 Smith ..... 336/83
5,726,615 A * 3/1998 Bloom ..... 336/83
6,583,697 B2 * 6/2003 Koyama et al. ..... 336/83

* cited by examiner

*Primary Examiner*—Lincoln Donovan
*Assistant Examiner*—Jennifer A. Poker
(74) *Attorney, Agent, or Firm*—Harness, Dickey & Pierce, P. L. C.

(57) ABSTRACT

A coil module applied in a transformer. The coil module includes at least one conductive wire and an insulating encapsulator. A portion of the conductive wire is wound into coils of a certain loop number. The coils are encapsulated by the insulating encapsulator. A metal core is provided when manufacturing a transformer. Desired coil modules are selected and installed onto the transformer so as to surround the metal core of the transformer. The coil modules are thus connected in series or in parallel for forming a desired specification of the transformer.

15 Claims, 7 Drawing Sheets

TRANSFORMERS USING COIL MODULES AND RELATED MANUFACTURING METHOD THEREOF

BACKGROUND OF THE INVENTION

1. Field of Invention

The present invention relates to transformers. More particularly, the present invention relates to coil modules and transformers which use the coil modules.

2. Description of Related Art

Coil elements are widely used in transformers and other electronic devices. However, coiling procedures often take too much time and become too complicated. Besides, implicit dangers such as accidental fires or electronic shocks might occur because of incautious manufacturing or usage.

Please refer to FIG. 1(*a*), which shows a schematic cross-sectional view of a traditional transformer 10 and coils thereon. The transformer 10 has a bobbin 101, pins 102, a metal core 103, insulation tapes 104, 105, and coils 106.

The bobbin 101 supports the pins 102 and the metal core 103. The insulation tapes 104 are used so that the positions of the coils 106 follow certain safety standards. The coils 106 are coiled in sequence one after another until all necessary coils 106 are installed on the bobbin 101. Each coil 106 has two wires connected to the pin 102 for connecting to other elements in certain applications. The tapes 105 are provided so that the coils 106 of different sets keep proper distance.

Please refer to FIG. 1 (*b*), which shows a schematic, cross-sectional view of another traditional transformer 11. Similarly, the transformer 11 has a bobbin 111, pins 112, a core 113, insulation layers 114 and coils 116.

The bobbin 111 supports the pins 112, the core 113, and the insulation layers 114. The coils 116 are coiled on the bobbin 111, one layer after another. In this example, four coil layers 1161, 1162, 1163, 1164 have different coil loops for performing two sets of electric voltage transformation. The coil layers 1161 and 1163 are used to function as primary coils of the transformer 11 for inputting electric voltage, and the layers 1162 and 1164 are used to function as secondary coils of the transformer 11 for outputting the resultant electric voltage.

The coiling procedures in both examples in FIG. 1(*a*) and FIG. 1(*b*) are slow because the coil wires are wound one layer after another. Incautious operators in a factory may make mistakes regarding loop number of coils for some layers. However, coils of other layers need to be unwound first before correcting the loop number of coils of the faulty layer.

Such coiling methods are also imprecise. In the example of FIG. 1(*a*), the thickness of tapes 104 and 105 are difficult to control. In FIG. 1(*b*), the insulation layers 114 take up unnecessary space and increase the size of the transformer 11. Also, coil wires may have different lengths even if the coil loops are the same when the coils are not neatly wound. Besides, coils are easily broken or fractured during winding, particularly when the bobbin structure is complicated like the one 111 shown in FIG. 1(*b*).

Therefore, there are still many problems for manufacturing transformers.

SUMMARY OF THE INVENTION

As seen from the above description, there is a strong need for flexible and reliable coil elements and transformer. An embodiment of the present invention provides a coil module. The coil module has a conductive wire and an insulating encapsulator. The conductive wire has a portion wound into coils. The loop number of the coils is selected from a predetermined set. The coils define a coil opening. The insulating encapsulator encapsulates the coils and defines a core opening. An outline of the core opening is within the coil opening.

A metal core is provided for manufacturing a transformer. Next, coil modules of necessary coil loops are selected. These coil modules are installed so that the core opening of the coil module surrounds the metal core. Besides, these coil modules are arranged as a stack. The coils of two adjacent coil modules are separated by the insulating encapsulators of the two adjacent coil modules.

The procedure of manufacturing transformers is therefore simplified and flexible. Furthermore, the coil modules are stacked directly so that the height of the transformer is reduced. The insulating encapsulator also protects the coils from damage by manufacturing or usage. Therefore, the present invention provides a nice solution for coiling in transformers that is flexible, improves quality and has low manufacturing cost.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principles of the invention. In the drawings, FIG. 1(*a*) is a schematic, cross-sectional view of a conventional transformer;

FIG. 2(*b*) is side view of FIG. 2(*a*);

FIG. 5(*b*) shows a top view of FIG. 5(*a*);

FIG. 7(*b*) schematically illustrates coil modules according to the present invention in parallel connection.

DESCRIPTION OF THE PREFERRED EMBODIMENTS

Preferred Embodiment

Figure 1A:
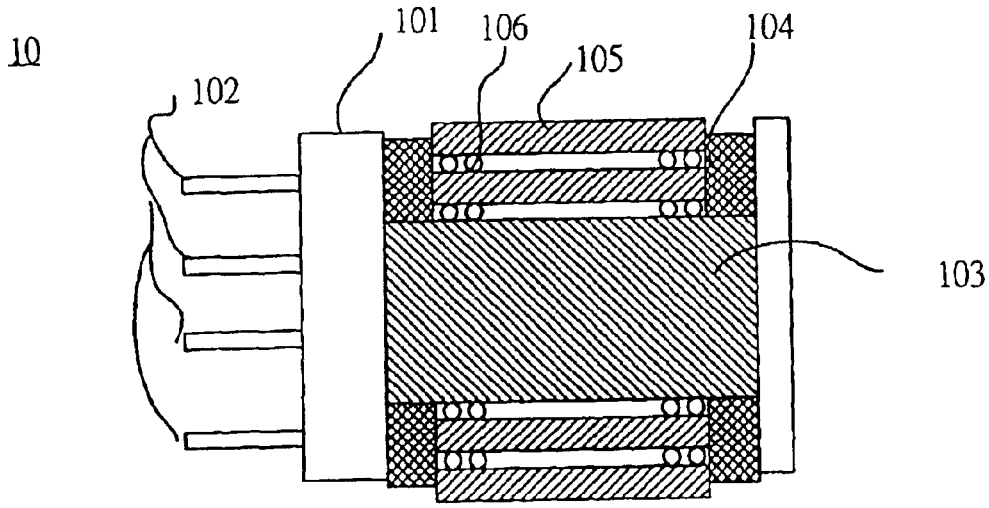
Fig.1(a)(PRIOR ART)
FIG. 1(*b*) is a schematic, cross-sectional view of another conventional transformer.
Figure 1B:
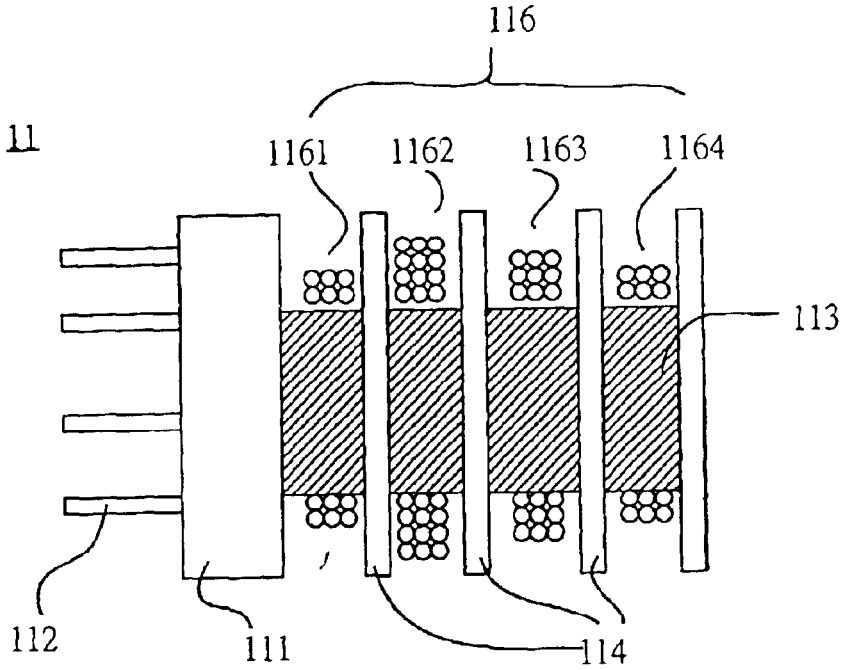
Fig.1(b)(PRIOR ART)
Figure 2A:
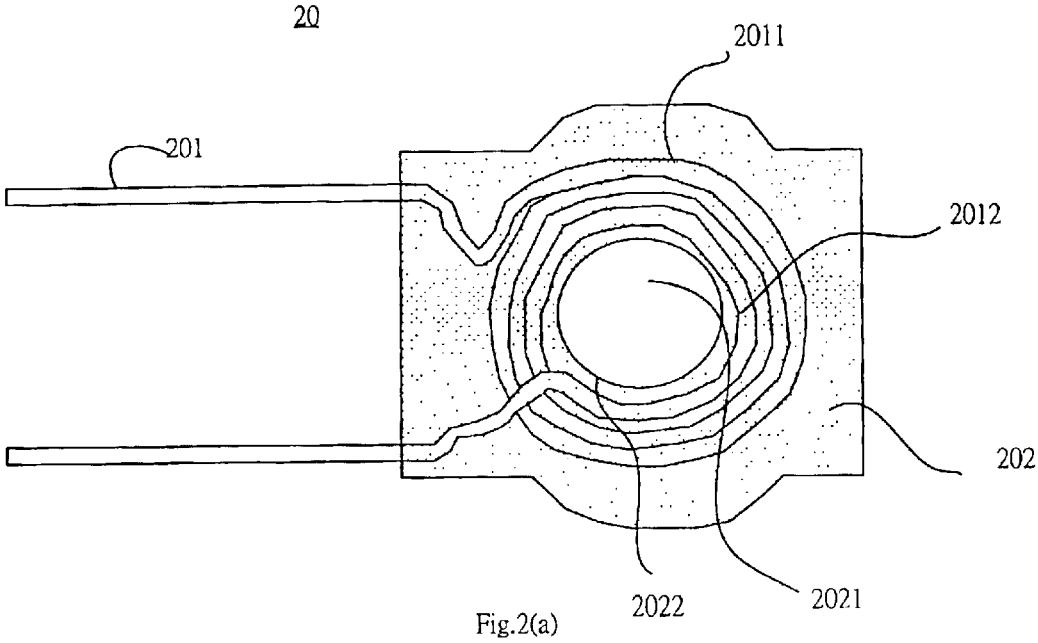
FIG. 2(*a*) is a schematic view of an embodiment of a coil module according to the present invention.
Figure 2B:
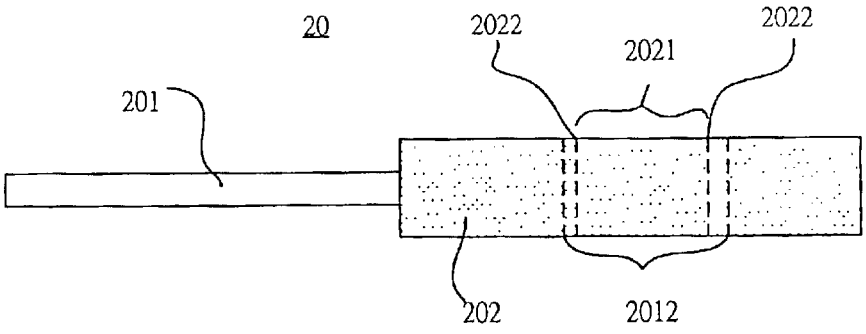

Please refer to FIG. 2(*a*) and FIG. 2(*b*), which show different views of a coil module 20 according to the present invention. FIG. 2(*b*) is the side view of FIG. 2(*a*). The coil module 20 has a conductive wire 201. An enamel-insulated wire is an example of the conductive wire 201. The conductive wire has a portion wound into coils 2011 of a loop number, and the loop number is selected from a predetermined set. In this example, the loop number of the coils 2011 is 4, which is selected from a predetermined set of {2.5, 3, 4, 5, 10, 20}. The designer can choose the predetermined set.

In addition to the conductive wire 201, the coil module 20 also has an insulating encapsulator 202. The insulating encapsulator 202 encapsulates the coils 2011 of the conductive wire 201. The coils 2011 define a coil opening 2012. In addition, the insulating encapsulator 202 defines a core opening 2021, and the outline 2022 of the core opening 2021 is within the coil opening 2012.

In this embodiment, the insulating encapsulator 202 can be made of plastic material. Thermosetting plastic or other insulation materials are used for manufacturing the shapes of the insulating encapsulator 202. A winding machine or a stamping machine, for example, can be used to form the coils 2011 of the coil module 20.

Figure 3A:
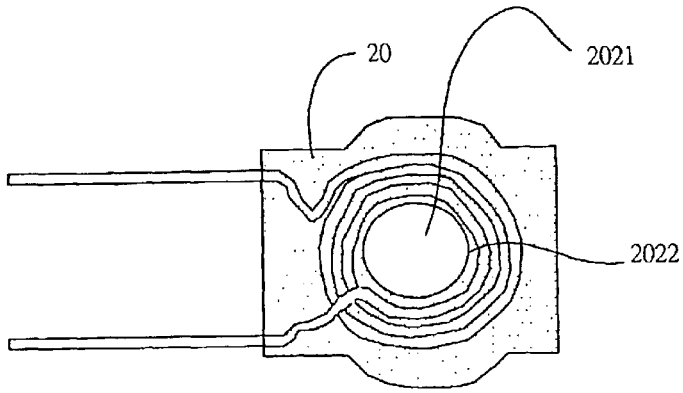
FIG. 3(*a*), FIG. 3(*b*), and FIG. 3(*c*) are schematic views illustrating steps for installing a coil module according to the present invention.
Figure 3B:
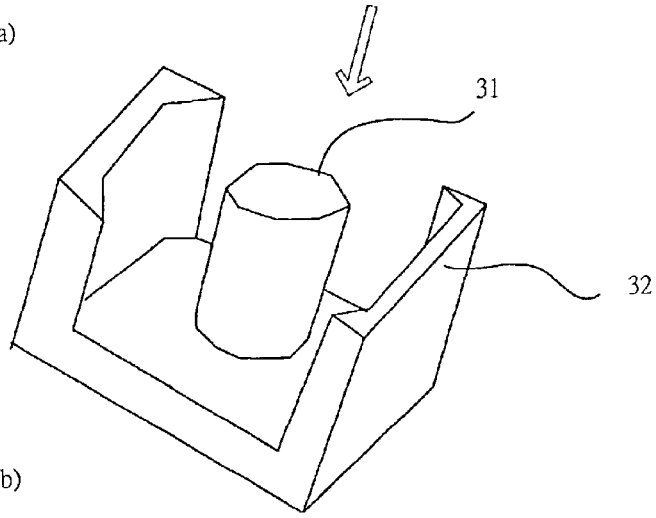
Figure 3C:
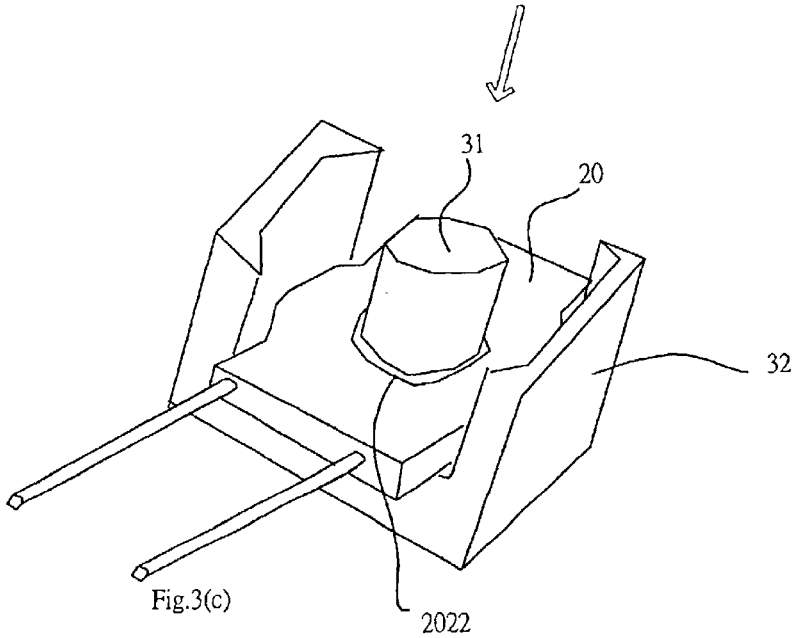

Please refer to FIGS. 3(*a*) to 3(*c*), which show how to assemble the coil modules 20 into a transformer. A metal core 31 is set on the base 32. The coil module 20 is put around the metal core 31 through the core opening 2021 so that the outline 2022 of the core opening 2021 surrounds the metal core 31.

Usually, a transformer has two or more coils. The coils for inputting voltage are called the primary coils. The coils for outputting a resultant voltage from an electromagnetic reaction are called the secondary coils. By adjusting the loop numbers of the primary coils and the secondary coils, a transformer meeting a specific requirement is obtained. The coil modules 20 with different loop numbers can be manufactured in advance. For example, coil modules 20 of loop numbers 4, 5, 6, . . . , 100 are manufactured and tested. The coiling process is dramatically simplified. Coiling in a transformer with specific requirements only requires selecting coil modules 20 of necessary loop numbers and installing these coil modules 20 into the transformer.

Figure 4:
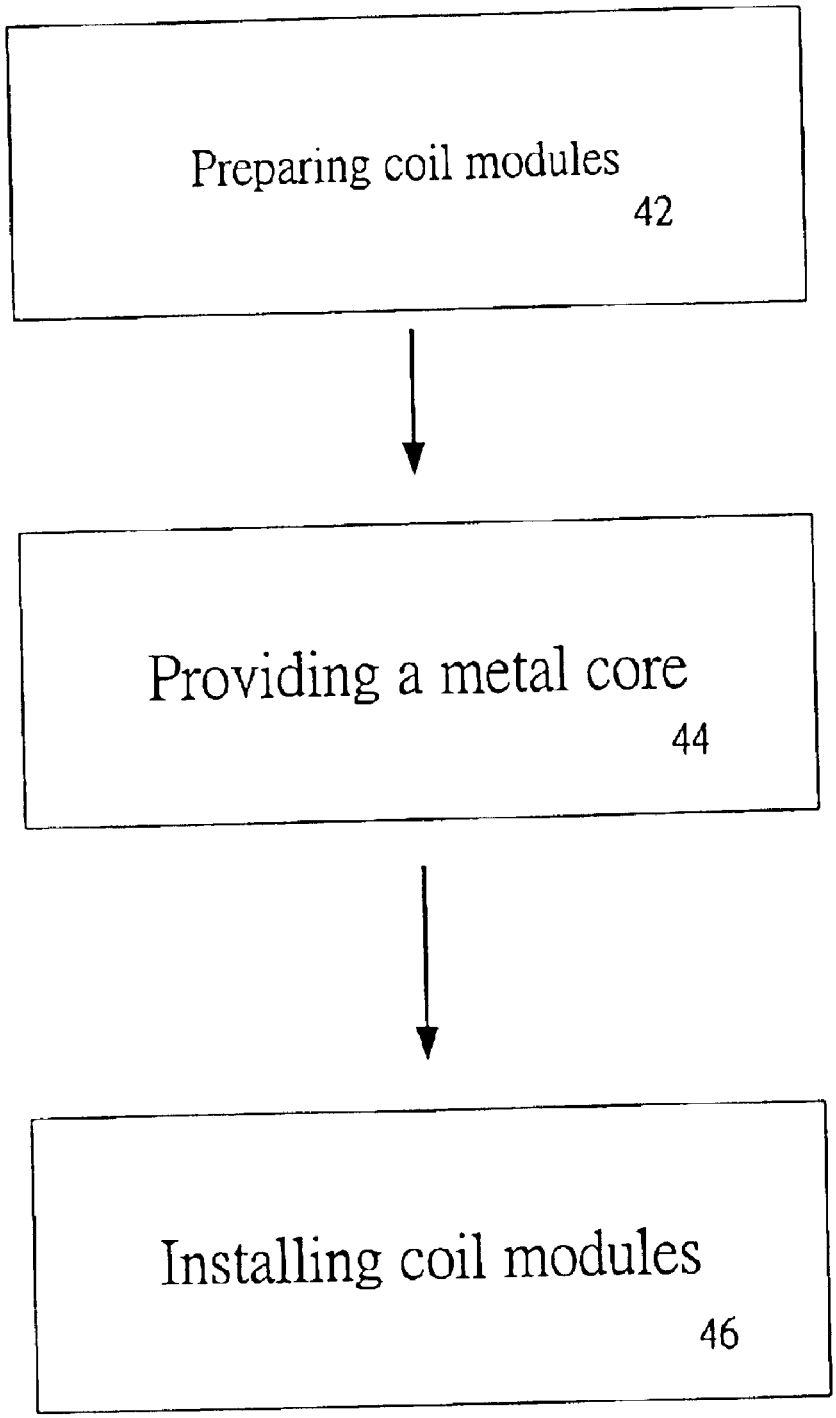
FIG. 4 is a flowchart for installing coil modules according to the present invention.

In conclusion, an embodiment for manufacturing a transformer includes the following steps, with reference to the flowchart in FIG. 4. Firstly, the coil modules 20 are prepared (step 42). The coil modules 20 of particular loop numbers are produced in advance as standard elements. Next, the metal core 31 as shown in FIG. 3(*b*) is provided (step 44). Then, the coil modules of necessary loops are selected and installed in the transformer (step 46) so that the outline 2022 of the core opening 2021 of the coil modules surrounds the metal core 31 as shown in FIG. 3(*a*) to FIG. 3(*c*).

Figure 5A:
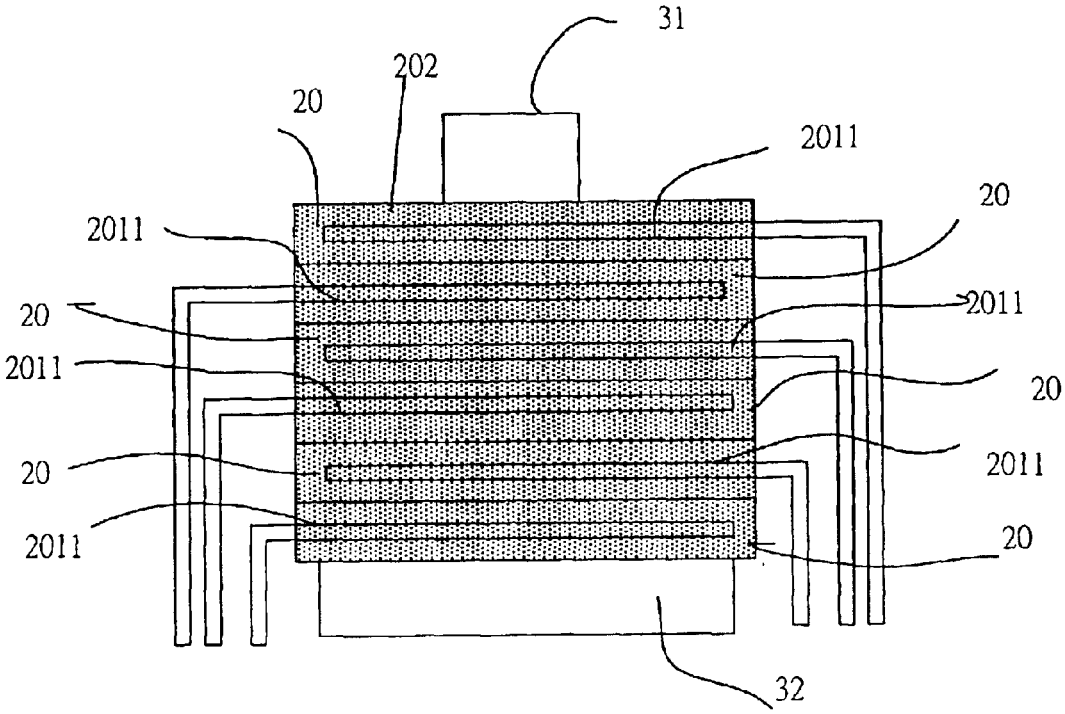
FIG. 5(*a*) shows a schematic view of part of a transformer using coil modules according to the present invention.
Figure 5B:
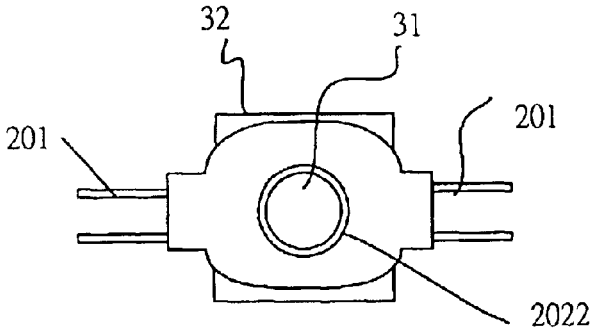

The coil modules 20 are arranged as a stack when they are installed in the transformer as shown in FIG. 5(*a*) and FIG. 5(*b*). FIG. 5(*b*) is a top view of FIG. 5(*a*). The coil 2011 of the coil module 20 is encapsulated with the insulating encapsulator 202. Therefore, the coils 2011 of each coil 20 are separated by the insulating encapsulator 202. In other words, the distance between coils 2011 of two adjacent coil modules 20 is controlled by the thickness of the insulating encapsulators 202 of the two adjacent coil modules 202.

In addition, the coil module 20 only has coverage on the coils 2011. To prevent the unencapsulated part of conductive wires 201 of two adjacent coil modules 20 from getting too close, the edges of adjacent coil modules 20 point to different directions as shown in FIG. 5(*a*) and FIG. 5(*b*). In this example, the edges of the coil modules 20 of the primary coils are therefore arranged with different direction from that of the edges of the coil modules 20 of the secondary coils. However, the edges of the primary coil and the secondary coils can be arranged in a same direction if the coil modules 20 according to the present invention are applied to a larger transformer or the distance between conductive wires 201 is enough.

In the example shown in FIG. 2(*a*), each loop of the coils 2011 of the coil module 20 is placed on essentially the same plane. In other words, each loop extends from the coil opening 2012 to avoid overlapping with other loop. Such design reduces the height of each coil module and therefore reduces the height of the transformers. Nevertheless, loops of coils 2011 of one coil module 20 overlapping with others are also within the boundary of the present invention.

In addition, the number of conductive wires 20 is adjustable according to the needs of the designer and need not be limited to one single conductive wire 201 as shown in the above example. For example, a set of primary coils and secondary coils embedded into one coil module 20 is within the boundary of the present invention.

Figure 6A:
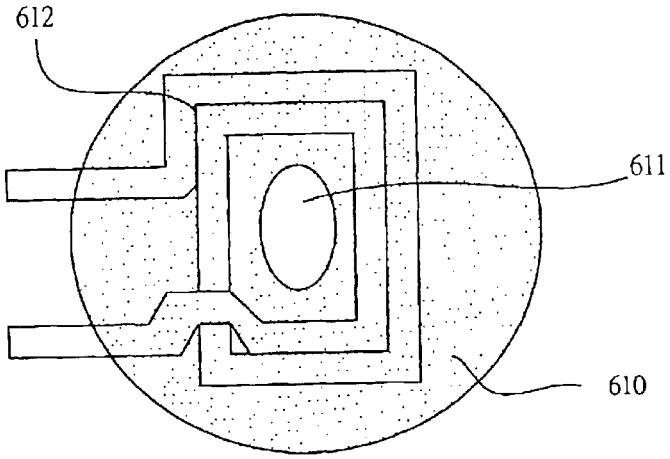
FIG. 6(*a*), FIG. 6(*b*) and FIG. 6(*c*) schematically illustrate other embodiments of coil modules according to the present invention.
Figure 6B:
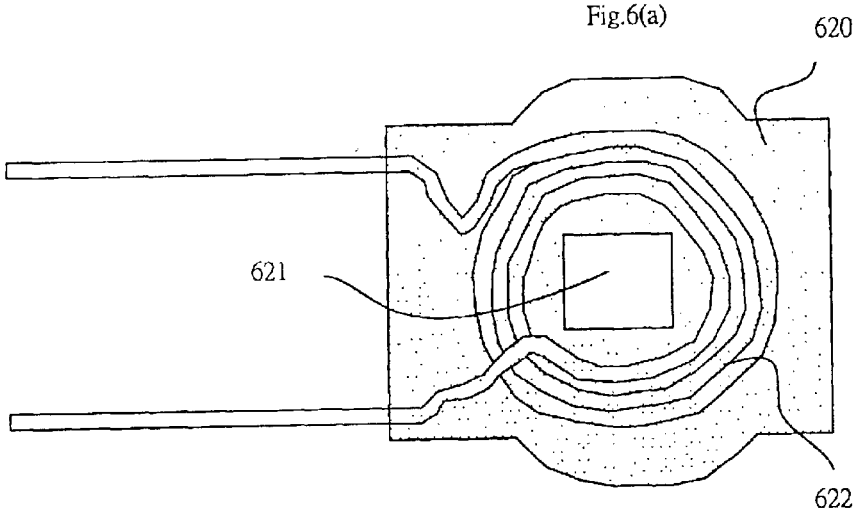
Figure 6C:
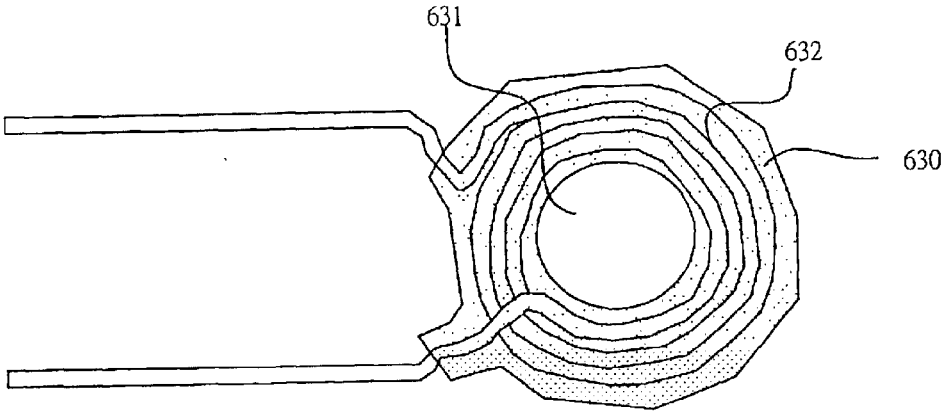

Also, the shapes of the insulating encapsulator 202, the core opening 2021, and the coils 2011 in FIG. 2(*a*) are adjustable according to the needs of the designer. The insulating encapsulators 610, 620, 630, the core openings 611, 621, 631 and coils 612, 622, 632 in FIG. 6(*a*) to FIG. 6(*c*) are variants of corresponding insulating encapsulators 201, core openings 2021, and the coils 2011 in FIG. 2(*a*).

Furthermore, the coil modules 20 depicted in FIG. 2(*a*) and FIG. 5(*a*) are stacked directly because the insulating encapsulator 202 encapsulates the coils 2011. However, inserting certain insulation objects, such as an insulation ring, between coil modules 20 is also within the boundary of coil module stack of the present invention.

Additionally, the loop number and conductive wire characteristic of the coil module 20 are predetermined so that the cost is reduced by mass production. In addition, series connection or parallel connection of coil modules 20 solves the problem that special types of coil modules 20 are not available on the predetermined list.

Figure 7A:
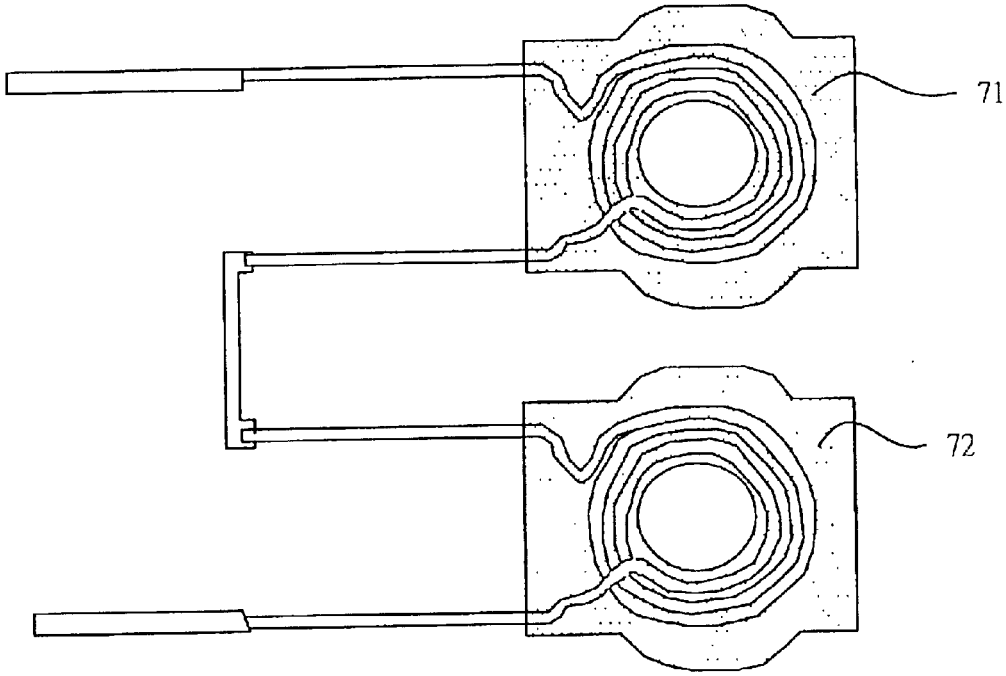
FIG. 7(*a*) schematically illustrates coil modules according to the present invention in series connection.
Figure 7B:
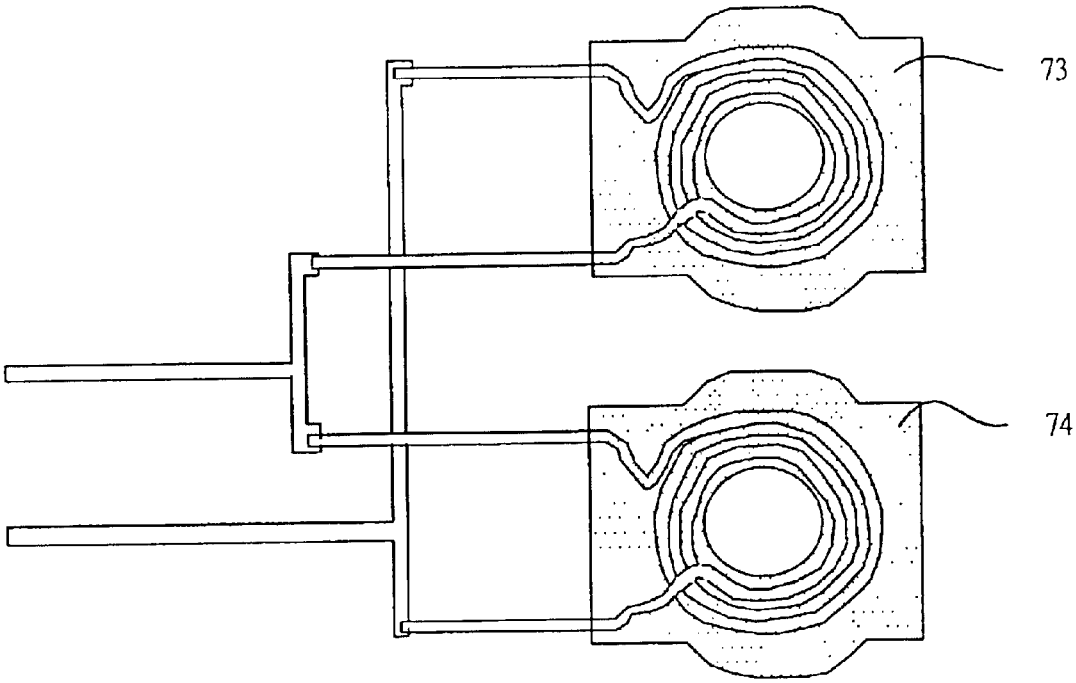

Please refer to FIG. 7(*a*) and FIG. 7(*b*). FIG. 7(*a*) shows a series connection of coil modules 71, 72 for higher loop number of coils, and FIG. 7(*b*) shows a parallel connection of coil modules 73, 74 for coils with a stronger capability for larger voltage.

In conclusion, it is apparent from the above description that the present invention has at least following advantages. Firstly, the flexibility and convenience of the coil modules greatly decrease the cost of manufacturing transformers. Secondly, the coils are protected by the insulating encapsulators and prevent damage during transformer manufacturing. Thirdly, the distance between coils in two adjacent coil modules is precisely and easily controlled by adjusting the thickness of the insulating encapsulators of the two adjacent coil modules. Also, the height of the transformers is reduced because the coil modules can be stacked directly.

It will be apparent to those skilled in the art that various modifications and variations can be made to the structure of the present invention without departing from the scope or spirit of the invention. In view of the foregoing, it is intended that the present invention cover modifications and variations of this invention provided they fall within the scope of the following claims and their equivalents.

What is claimed is:

1. A transformer comprising:

a metal core; and a plurality of coil modules, wherein each coil module comprises:

at least one conductive wire wherein a portion of said conductive wire is wound into coils of a predetermined loop number, said loop number is selected from a predetermined set, and said coils define a coil opening; and an insulating encapsulator comprising plastic material for encapsulating said coils, said insulating encapsulator defines an core opening, and an outline of said core opening is within said coil opening, wherein said plurality of coil modules are arranged as a stack, the outline of said core opening of each coil module surrounds said metal core, and said coils of two adjacent coil modules are separated by said insulating encapsulators of the two adjacent coil modules, and wherein a number of said coil modules is used to function as primary coils of said transformer and another number of said coil modules is used to function as secondary coils of said transformer.

2. The transformer of claim 1, wherein each loop of said coils of one coil module essentially are placed on a substantially same plane for reducing a height of said stack of said coil modules.

3. The transformer of claim 1, wherein a group of coil modules is connected in series.

4. The transformer of claim 1, wherein a group of coil modules is connected in parallel.

5. The transformer of claim 1, wherein said conductive wire is an enamel-insulated wire.

6. A method for manufacturing a transformer comprising:

providing a metal core;

preparing a plurality of coil modules, wherein each coil module comprises a conductive wire and an insulating encapsulator; and installing said plurality of coil modules, wherein said plurality of coil modules are arranged as a stack, and said coils of two adjacent coil modules are separated by said insulating encapsulators of said two adjacent coil modules, and wherein a number of said coil modules is used to function as primary coils of said transformer and another number of said coil modules is used to function as secondary coils of said transformer.

7. The method of claim 6 further comprising winding a portion of the conductive wire of each coil module into coils with a predetermined loop number wherein the coils define a coil opening and the predetermined loop number is selected from a predetermined set.

8. The method of claim 7, wherein the insulating encapsulator encapsulates the coils and defines a core opening, an outline of the core opening is within the coil opening and surrounds said metal core.

9. The method of claim 7, wherein each loop of said coils of said coil module essentially is placed on a substantially same plane for reducing a height of said stack of said coil modules.

10. The method of claim 8, wherein a group of coil modules is connected in series.

11. The method of claim 8, wherein a group of coil modules is connected in parallel.

12. The method of claim 6, wherein said conductive wire is an enamel-insulated wire.

13. A coil module comprising:

at least one conductive wire wherein a portion of said conductive wire is wound into coils of a predetermined loop number, said loop number is selected from a predetermined set, and said coils define a coil opening; and an insulating encapsulator comprising plastic material for encapsulating said coils;

wherein coils of two adjacent coil modules are separated by said insulating encapsulators of the two adjacent coil modules as the two adjacent coil modules are stacked together.

14. The coil module of claim 13, wherein each loop of said coils essentially is placed on a substantially same plane.

15. The coil module of claim 13, wherein said conductive wire is an enamel-insulated wire.

* * * * *